US006874698B1

(12) United States Patent
Stukenberg

(10) Patent No.: US 6,874,698 B1
(45) Date of Patent: Apr. 5, 2005

(54) SYSTEM OF MODULAR ARTIFICIAL ROCKS WITH RUNNING WATER

(76) Inventor: Daniel R. Stukenberg, W1786 Sunset Dr., Campbellsport, WI (US) 53010

( * ) Notice: Subject to any disclaimer, the term of this patent is extended or adjusted under 35 U.S.C. 154(b) by 85 days.

(21) Appl. No.: 10/225,879

(22) Filed: Aug. 21, 2002

Related U.S. Application Data

(60) Provisional application No. 60/315,400, filed on Aug. 27, 2001.

(51) Int. Cl.[7] ..... B05B 17/04

(52) U.S. Cl. ..... 239/12; 239/18; 239/20; D23/201; D11/145

(58) Field of Search ..... 239/12, 16, 17, 239/20, 23, 211; 52/604, 606, 503, 561; 446/85, 446/491; D23/201; D11/145, 139

(56) References Cited

U.S. PATENT DOCUMENTS

| | | | | |
|---|---|---|---|---|
| 3,901,439 A * | 8/1975 | Willis | ..... | 239/12 |
| D343,442 S * | 1/1994 | Cooper | ..... | D23/201 |
| 6,149,991 A * | 11/2000 | Okuda | ..... | 428/13 |
| 6,450,122 B1 * | 9/2002 | Frank | ..... | 119/259 |

* cited by examiner

*Primary Examiner*—Gene Mancene
*Assistant Examiner*—Thach H. Bui
(74) *Attorney, Agent, or Firm*—Donald Cayen

(57) ABSTRACT

A system of modular artificial rocks provides natural looking running water. A crevice rock has a floor and a barrier. A convex portion under the floor is over a reservoir. Water pumped through a hole in the crevice rock floor rises to a hole in the barrier. The water flows through the barrier hole and runs down the convex portion, from which it falls into the reservoir. The floor may have a depression that matches the size and shape of the convex portion. The system further comprises a second rock that interfits with the crevice rock barrier. Water is pumped simultaneously to the crevice rock floor hole and to a hole in a top surface of the second rock. The water from the second rock runs down and falls onto the crevice rock floor. A third rock may be interfit on the second rock and be similarly supplied with water.

28 Claims, 6 Drawing Sheets

SYSTEM OF MODULAR ARTIFICIAL ROCKS WITH RUNNING WATER

This application claims the benefit of U.S. Provisional Application No. 60/315,400 filed Aug. 27, 2001.

BACKGROUND OF THE INVENTION

1. Field of the Invention

This invention pertains to landscape decorations, and more particularly to apparatus that simulates small streams of water flowing over natural rock outcrops.

2. Description of the Prior Art

Water running over rocks and stones has great visual and aural appeal. Accordingly, it is well known for landscape designers to incorporate rocks and flowing water into yards and gardens. In some cases, natural rocks are available, either on the site or from a commercial supplier, so they can be used. On the other hand, natural water sources or courses are seldom present in a yard or garden. Consequently, it is often necessary to combine an artificial water system with the natural rocks. That is often difficult to do, because the rocks are rarely shaped or positioned to properly direct the water flow. Improperly directed water has a tendency to splash outside of the system, so the water must be frequently replenished.

U.S. Pat. No. 3,409,223 shows an artificial waterfall that uses small natural rocks in combination with a liner recessed into the ground. The rocks and a water source are arranged such that all the water flows back to the liner after being pumped from it to a topmost rock. The artificial waterfall of the U.S. Pat. No. 3,409,223 patent requires the availability of many small rocks, as well as the labor of lifting and properly arranging them. It is questionable whether the artificial waterfall of the U.S. Pat. No. 3,409,223 patent would lend itself to use with large natural rocks.

To solve the problems associated with using natural rocks in landscapes, various types of artificial rocks have been developed. The artificial rocks are usually hollow, which makes them much easier to handle than natural rocks. U.S. Pat. Nos. 4,385,088; 5,443,774; 5,543,100; 5,826,373; and 6,033,744 show examples of artificial rocks. None of the artificial rocks of the foregoing patents is used with running water.

U.S. Pat. Nos. 3,901,439 and 5,167,368 describe decorative self-contained waterfalls. However, the waterfalls of neither patent is associated with any large rocks.

My U.S. Pat. No. 6,405,937 discloses large artificial rocks in conjunction with waterfalls. Although my prior invention works very well, it nevertheless is subject to improvements.

SUMMARY OF THE INVENTION

In accordance with the present invention, a system of modular artificial rocks with running water is provided that combines large natural looking rocks with self-contained recirculating water. This is accomplished by apparatus that includes a crevice rock that both holds a supply of water and that directs the water to a sump.

The crevice rock comprises an enclosed barrier and a floor arranged to make a shallow pool. The barrier and floor are preferably molded as a single piece from any of a variety of materials. The barrier and floor have opposed exposed and hidden surfaces that cooperate to define a rather thin wall. The exposed surfaces have contours that simulate the shape of several relatively small rocks. The floor may have a depression.

At least a portion of the hidden surface of the crevice rock floor has a convex shape. If the floor has a depression, the convex portion may be of the same general contour as the depression. Preferably, there is a smooth junction between an area of the hidden surface of the barrier and an area on the floor convex portion. The barrier has a hole through it a short distance above the floor. The barrier hole is located above the junction of the floor convex portion with the barrier hidden surface. The crevice rock also has a hole through the floor.

The sump of the present invention comprises an open reservoir under the crevice rock. The reservoir need not lie completely under the crevice rock, but the convex portion of the crevice rock floor must overlie the reservoir. Preferably, the reservoir extends beyond the crevice rock side such that the reservoir is not entirely covered by the crevice rock.

In use, the reservoir is normally sunk into the ground and filled with water. A motor and pump are placed in the reservoir. The pump outlet is connected to the hole in the crevice rock floor. The crevice rock is placed over the reservoir such that the floor convex portion is over the reservoir. The exposed part of the reservoir is covered with a flat stone or similar decorative component.

When the pump is energized, water flows into the crevice rock through the floor hole and fills the crevice rock until the water level reaches the barrier hole. Any additional water pumped into the crevice rock spills out the barrier hole. The water runs down the barrier hidden surface to the junction with the floor convex portion. The water then runs along the convex portion to its lowermost point. From there, the water falls into the reservoir. The result is a very natural looking and sounding pool of circulating water. When necessary, the stone covering the exposed part of the reservoir can be removed for inspecting and cleaning the reservoir.

Further in accordance with the present invention, a natural looking artificial cap rock can be used in conjunction with the crevice rock. The cap rock is hollow and has a bottom surface that interfits with the barrier of the crevice rock. The cap rock bottom surface may have a small notch as the interfitting surface. A front end of the cap rock overhangs the crevice rock barrier and is over the crevice rock floor. The back end of the cap rock overhangs outside of the crevice rock and is supported by earth or the like. The cap rock has an opening through its wall at the top surface. Close to the front wall and under the opening is a depression.

The pump in the reservoir is connected to both the floor hole in the crevice rock and to the opening in the cap rock. Consequently, energizing the pump causes water to flow simultaneously into the crevice rock floor and out of the opening in the cap rock. The water flowing from the cap rock collects in the depression, from which the water runs down the cap rock front end and drops into the crevice rock pool. If desired, a small natural rock can be placed over the cap rock opening to diffuse the water flowing from the opening.

The present invention may include one or more intermediate hollow artificial rocks between the crevice rock and the cap rock. Each intermediate rock has an opening in the top surface thereof that is connected to the pump in the reservoir. There may be a depression in the intermediate rock top surface under the opening. Each intermediate rock is designed to rest on and interfit with the crevice rock or with a next lower intermediate rock. Each intermediate rock has a back end that overhangs the crevice rock or the next lower intermediate rock and that is supported by earth or similar material. The intermediate rocks are designed such that water flowing from the openings in them runs down their front ends and into either the crevice rock pool or into the depression in the next lower intermediate rock.

The method and apparatus of the invention, using a crevice rock having a convex portion on the hidden surface of the floor, thus presents a very attractive and natural looking water system for an outdoor landscape. The crevice rock is suitable for use alone, even though a cap rock and one or more intermediate rocks add flexibility and enhancement to the system.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
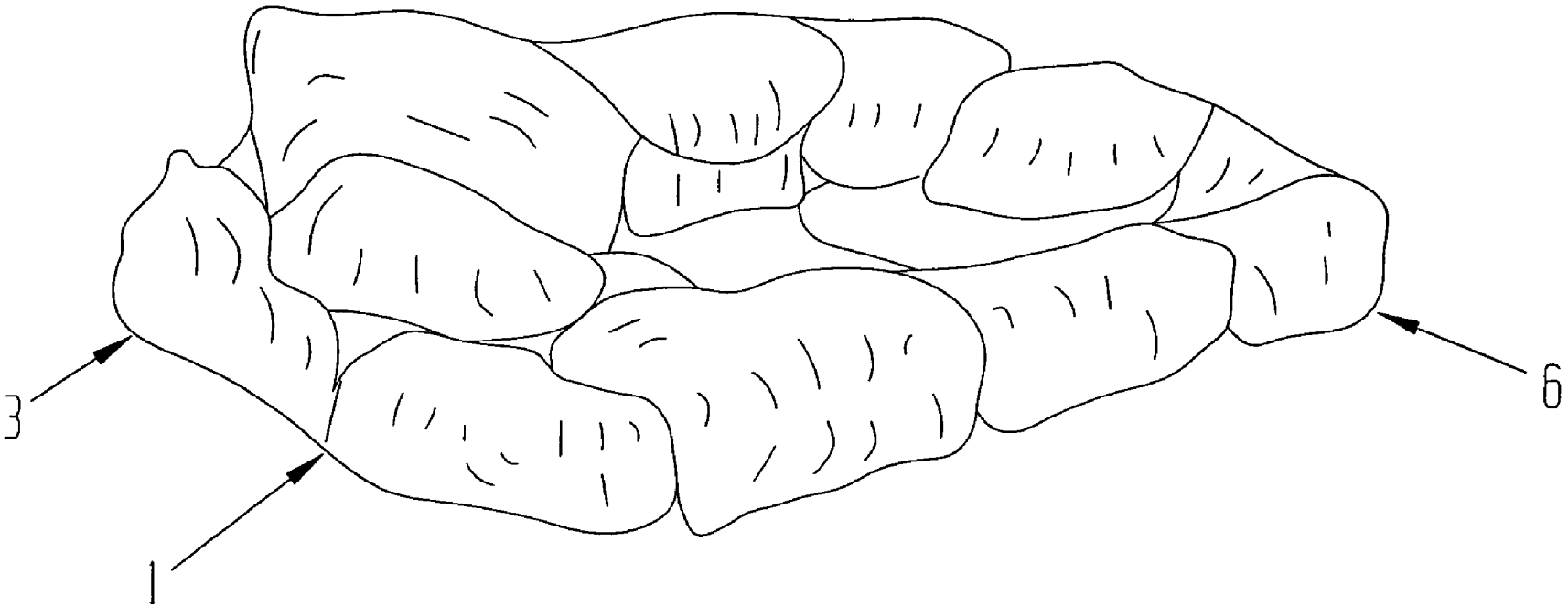
FIG. 1 is a perspective view of the crevice rock of the present invention.
Figure 2:
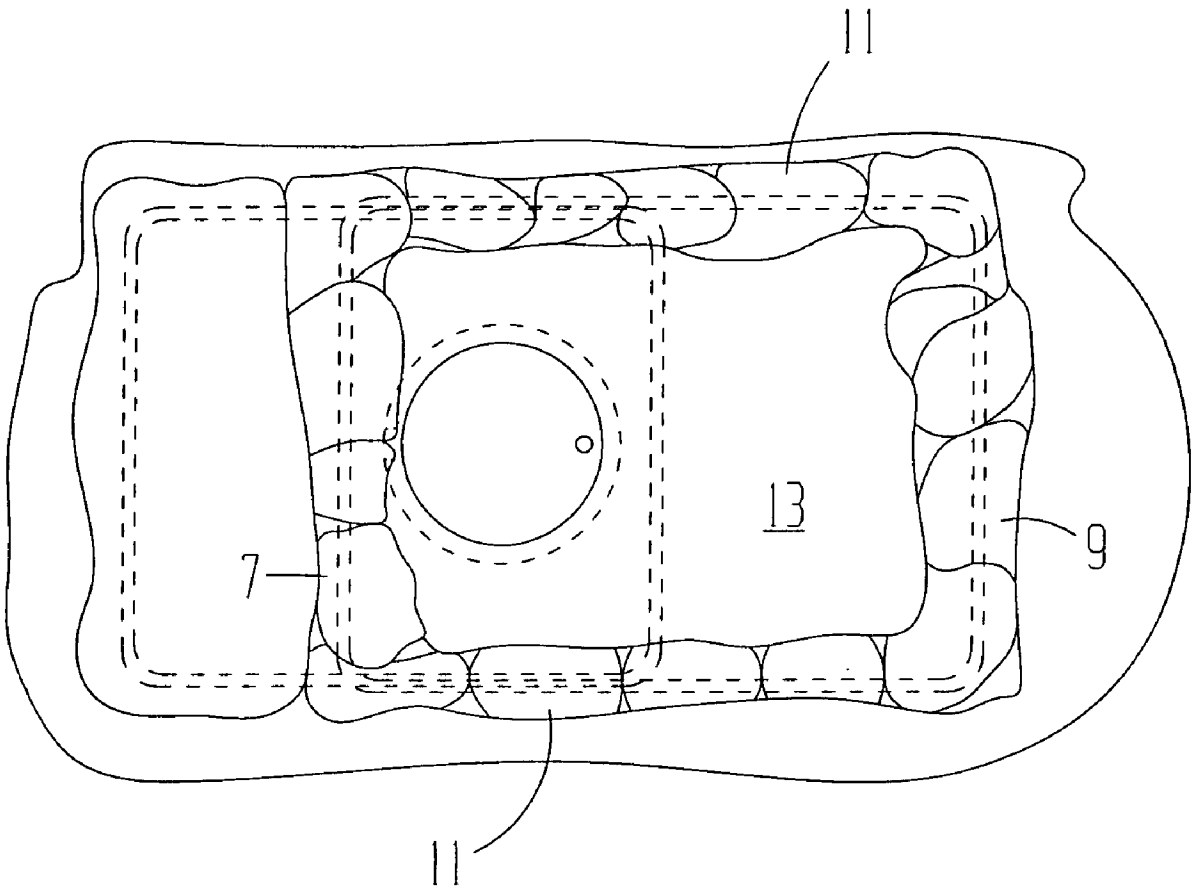
FIG. 2 is a top view of the crevice rock.
Figure 3:
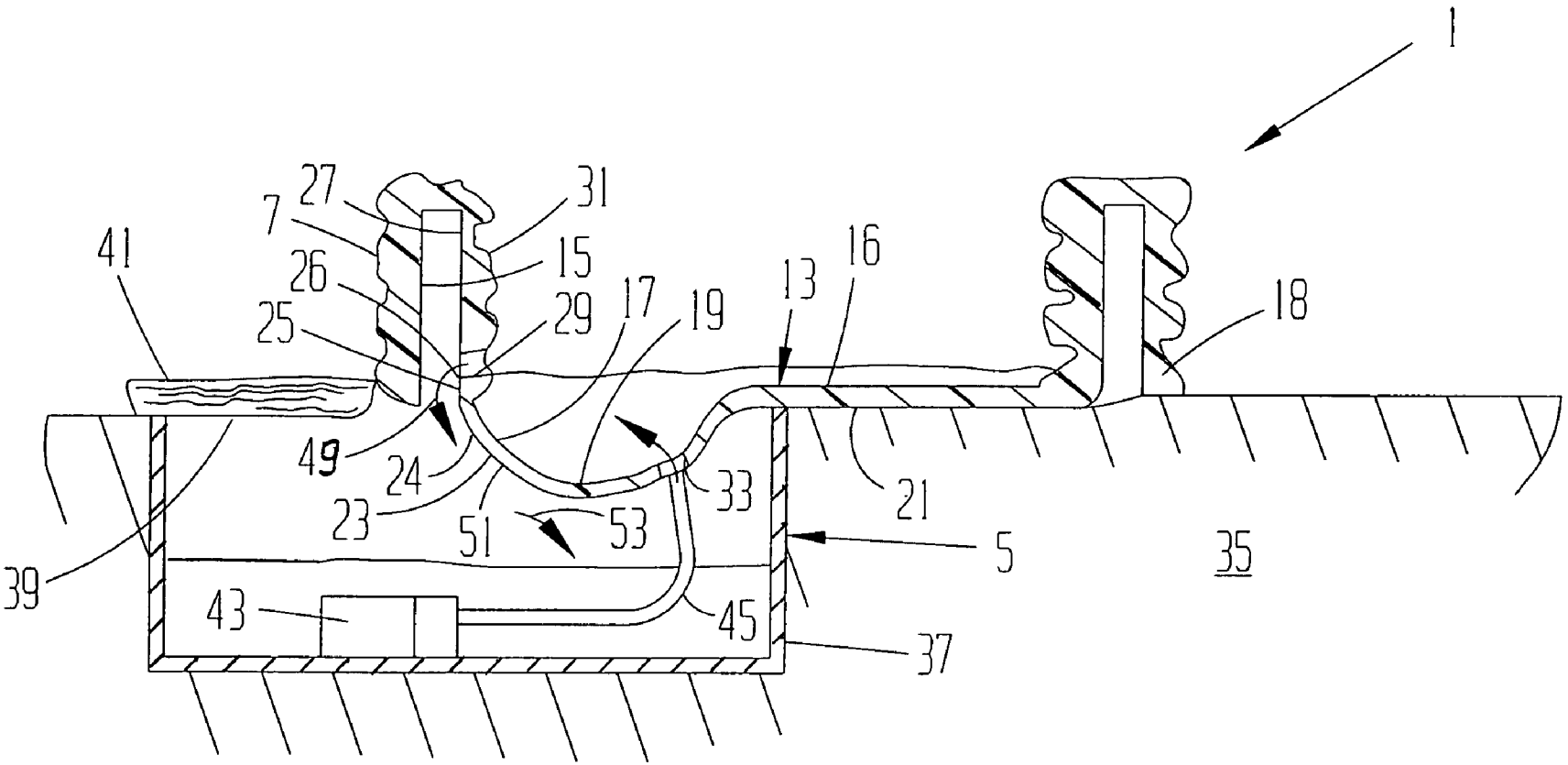
FIG. 3 is a longitudinal cross-sectional view of FIG. 2.

Referring to FIGS. 1–3, a system 1 of modular artificial rocks with running water is illustrated that includes the present invention. The system 1 is particularly useful for decorating yards and gardens. However, it will be understood that the invention is not limited to outdoor landscape applications.

The system 1 is comprised of a crevice rock 3 and a reservoir 5. First considering the crevice rock 3, it is molded from any of a variety of materials in any suitable size, shape, and color. For example, the crevice rock may be manufactured according to the methods described in U.S. Pat. Nos. 4,668,451; 4,940,558; or 5,435,949. The crevice rock may also be produced by the gunnite process as practiced by Cost Of Wisconsin of Germantown, Wis.

The particular crevice rock 3 illustrated is merely representative of a wide variety of shapes and surface contours in which it may be made. As illustrated, the surface contour is designed and produced to simulate a rock pool. For that purpose, the crevice rock has an enclosed barrier 6 composed of a pair of ends 7 and 9 and opposed sides 11 that surround a floor 13. Preferably, the ends 7 and 9 and the sides 11 are hollow, such as by having an open continuous groove 15 in them. Consequently, the entire crevice rock is in the form of a single relatively thin wall 18 having an exposed surface 16 and a hidden surface 21. The exposed surface 16 of the ends and sides is shaped and sized to simulate rocks piled one on another in a rectangle around the floor 13. The exposed surface of the floor may be contoured to simulate flat rocks.

In the illustrated construction, the crevice rock floor 13 has a depression 17. The depression 17 has an exposed surface 19 that may, but need not, be generally hemispherical. The depression exposed surface 19, like the floor 13, may be contoured to simulate flat rocks.

It is a feature of the invention that the hidden surface 21 of the floor 13 has a convex portion 23. In the preferred embodiment, the convex portion 23 is generally hemispherical in shape. If the floor has a depression, the convex portion preferably follows the shape of the depression, as is illustrated. The convex portion 23 blends into the hidden surface of the groove 15 in one of the ends 7 or 9 or sides 11. As illustrated, the convex portion has an area 24 that blends at a smooth junction 25 into an area 26 of the hidden surface 27 of the groove in the end 7.

There are two holes in the crevice rock 3. A first hole 29 is at one of the ends 7 or 9 or sides 11. The first hole 29 is a short distance above the floor 13. The first hole passes through the wall 18 from the exposed surface 16 to the groove 15. As illustrated, the first hole passes through the end 7 between its exposed surface 31 and the groove hidden surface 27. The first hole is located slightly above the junction 25 of the floor convex portion 23 with the groove hidden surface 27.

The second hole 33 in the crevice rock 3 is in the floor 13. If the floor has a depression, such as the depression 17, the hole 33 is preferably in the depression. If desired, a hose fitting can be molded into the hole 33 at manufacture.

The crevice rock 3 is used by first digging a hole in the ground 35 at the desired location in a landscape. The reservoir 5 is set in the hole. The crevice rock is placed on the ground 35 such that the convex portion 23 is over the reservoir. In the particular system 1 depicted, the reservoir extends beyond the crevice rock end 7. The exposed part 39 of the reservoir is covered with a large flat stone 41 or similar decoration. An electric motor and pump 43 are placed in the reservoir. The outlet of the pump 43 is connected by a tube 45 to the hole 33 in the crevice rock floor 13.

To use the system 1, the reservoir 5 is partially filled with water. Preferably, the water does not reach to the crevice rock convex portion 23. Energizing the motor causes the pump to pump water from the reservoir to the crevice rock hole 33. The water fills the depression 17, covers the floor 13, and rises to the level of the hole 29. The water overflows through the hole 29 and runs down the hidden surface 27 of the groove 15 to the junction 25, arrow 49. The water naturally follows the contour of the floor convex portion 23 down to its lowermost point 51. From there, the water falls by gravity back to the reservoir, arrow 53. The result is a very attractive shallow rock pool with constantly circulating water. When desired, the stone 41 can be removed for cleaning the reservoir or for performing maintenance on the pump.

Figure 5:
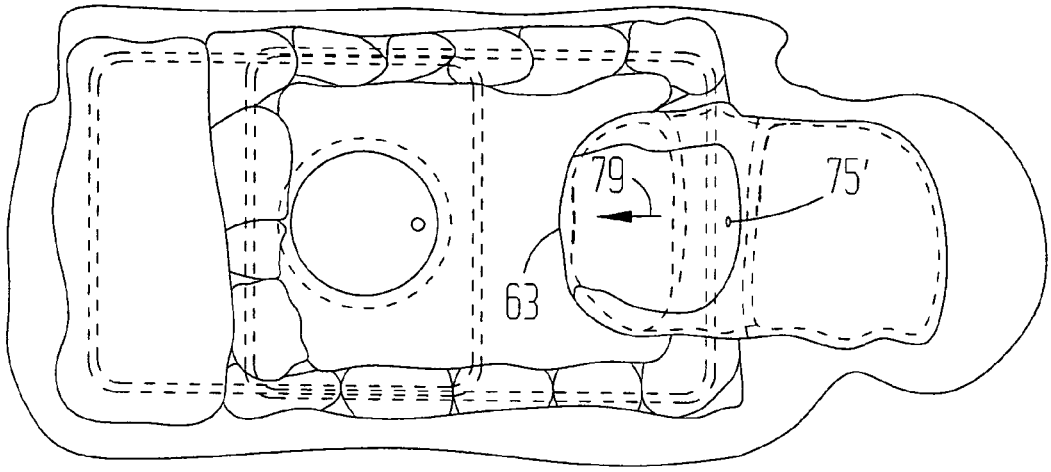
FIG. 5 is a top view of FIG. 4.
Figure 4:
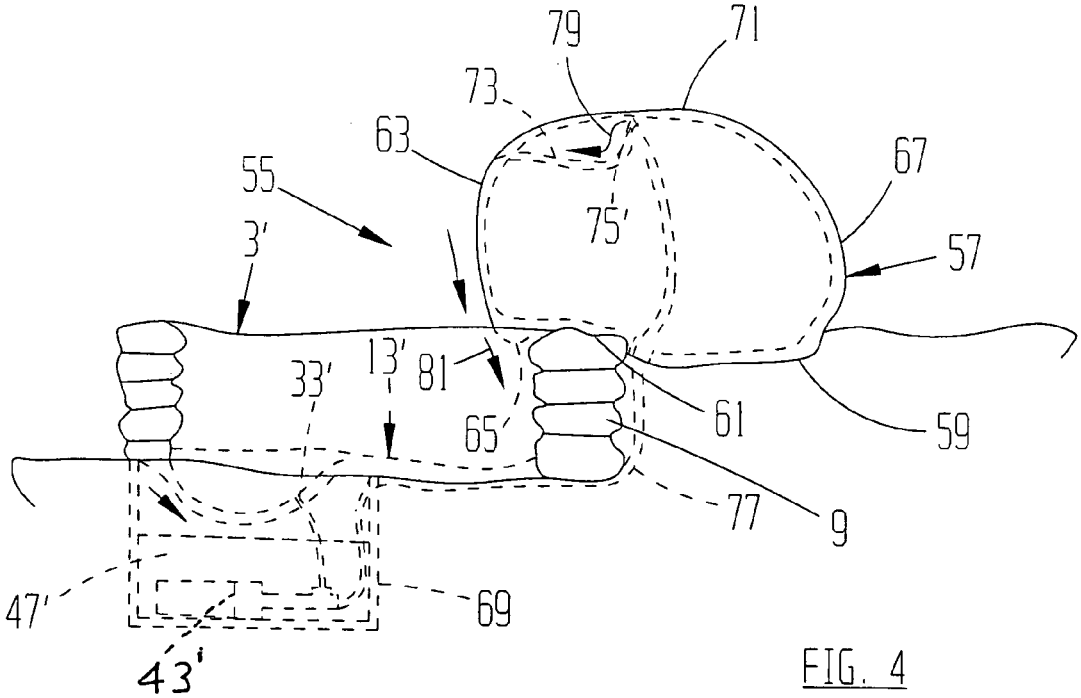
FIG. 4 is a side view showing a cap rock in combination with the crevice rock.

Further in accordance with the present invention, one or more additional artificial rocks can be used with the crevice rock. Turning to FIGS. 4 and 5, a system 55 of modular artificial rocks is shown that includes a crevice rock 3' and a hollow artificial cap rock 57. Like the crevice rock 3', the cap rock 57 may be of any desired size, shape, color, and surface contour. The specific cap rock shown has a bottom surface 59 with a notch 61 near a front end 63. The cap rock bottom surface 59 and front end 63 join in the form of a drip edge 65. The notch 61 is placed over one of the ends or sides, such as end 9', of the crevice rock 3' such that the cap rock drip edge 65 overhangs the crevice rock floor 13'. The back end 67 of the cap rock 57 overhangs outside of the crevice rock. The back end 67 of the cap rock is supported by the ground 69.

In the top surface 71 of the cap rock 57 is a depression 73. There is an opening 75 through the wall of the cap rock at a higher level than the depression 73. The opening 75 may be generally round and have a conventional pipe fitting molded into it at manufacture. Alternately, the opening may be in the shape of a rectangular slot. In that case, a suitable orifice fitting can be molded into the rock at manufacture.

In the preferred embodiment, the cap rock 57 and the crevice rock 3' are supplied with water simultaneously from a reservoir 69 under the crevice rock. The versatility of the present invention is illustrated by the fact that the reservoir 69 of the system 55 may be fully covered by the crevice rock. A motor and pump 43' in the reservoir 69 supply water to the crevice rock 3' through a hole 33' as explained previously. In addition, water is supplied to the opening 75 in the cap rock. For that purpose, a tube 77 leads from the pump 43' through the top rock bottom surface 59 to the opening 75.

In operation, the water flows out the cap rock opening 75 and into the depression 73, arrow 79. From the depression 73, the water runs down the cap rock front end 63 to the drip edge 65 and then falls into the crevice rock 3', arrow 81. The design of the cap rock in relation to the crevice rock virtually eliminates any splashing of the water outside the system 55. Consequently, the need for replenishing the water supply in the reservoir 69 is minor.

Figure 6:
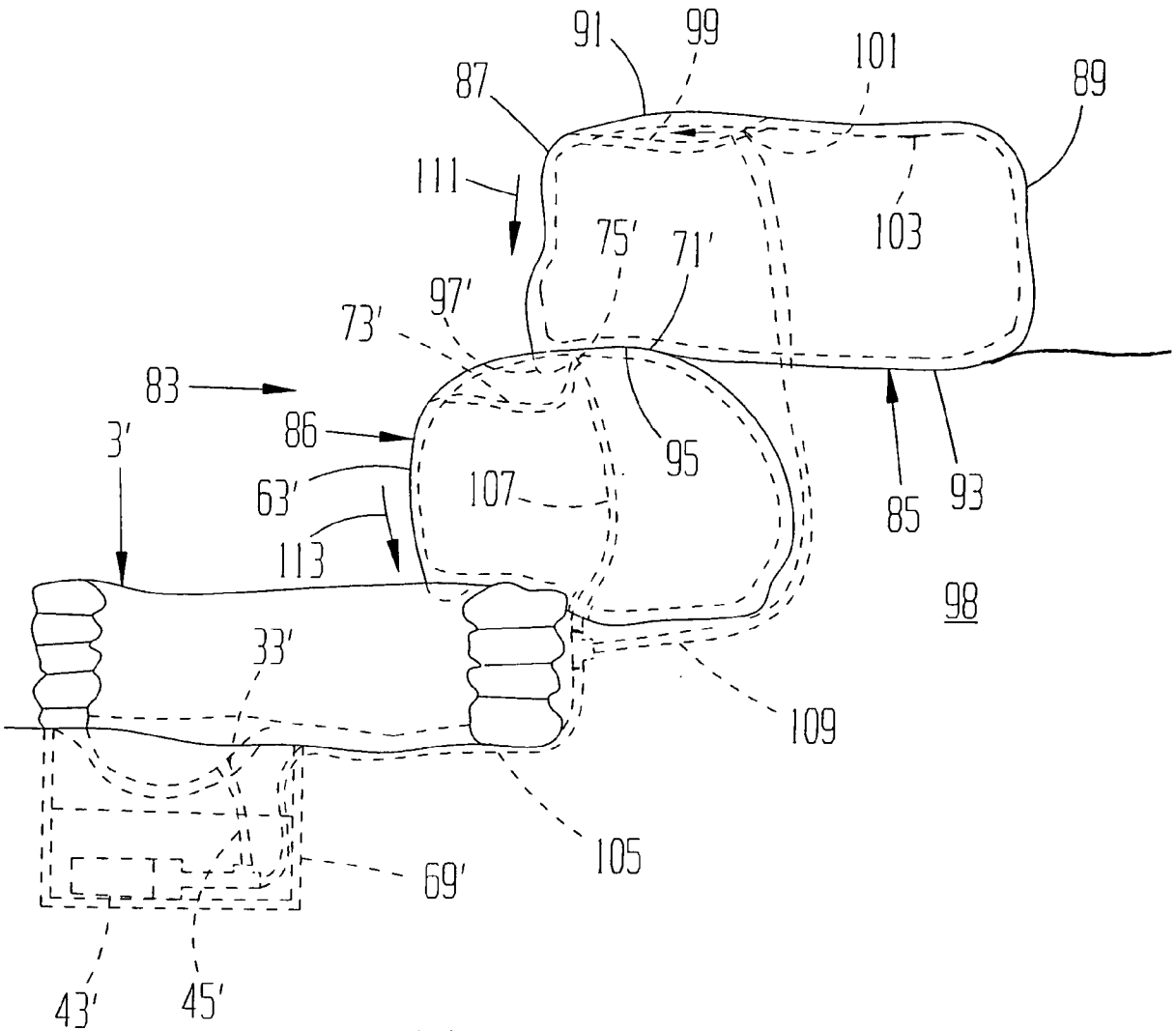
FIG. 6 is a side view showing an intermediate rock and a cap rock in association with the crevice rock.
Figure 7:
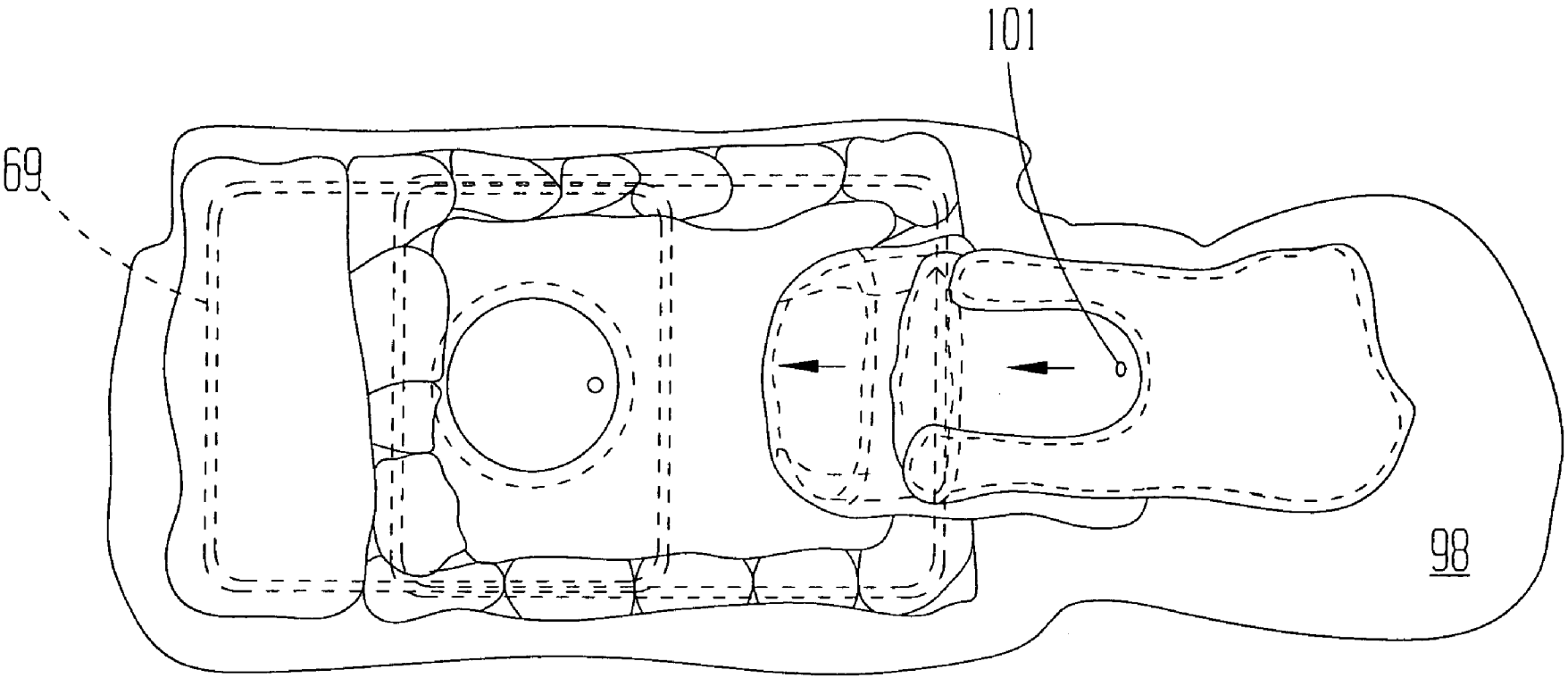
FIG. 7 is a top view of FIG. 6.

Turning to FIGS. 6–8, a further system 83 of modular artificial rocks with running water is shown. The system 83 includes a reservoir 69' and motor and pump 43' that are substantially identical to the corresponding components of the system 55 of FIGS. 4 and 5. The system 83 further comprises a crevice rock 3' that may be the same as the crevice rock 3' of the system 55. In addition, the system 83 includes a hollow cap rock 85 and an intermediate rock 86. As illustrated, the cap rock 85 and the intermediate rock 86 have different shapes, sizes, and contours. However, identical artificial rocks can be used as the cap and intermediate rocks, if desired. The versatility of the invention is further demonstrated by the fact that the cap rock 57 of the system 55 described previously may be used as the intermediate rock of the system 83. Conversely, the cap rock 57 of the system 55 can be used, if desired, as the topmost rock of the system 83, and the rock 85 may be used as the intermediate rock.

In the particular system 83, the cap rock 85 has a front end 87, back end 89, top surface 91, and bottom surface 93. The cap rock bottom surface 93 has a notch 95 that interfits with the top surface 71' of the intermediate rock 86. The bottom surface and front end 87 of the cap rock join at a drip edge 97 that overhangs a depression 73' in the intermediate rock top surface 71'. The back end 89 of the cap rock is supported by ground 98 or other suitable material.

The cap rock 85 has a depression 99 in the top surface 91. An opening 101 extends through the cap rock wall 103 at a slightly higher level than the depression 99. The opening 101 may be round or rectangular. In either case, an appropriate fitting may be cast into the opening at manufacture.

The system 83 operates by providing water to the crevice rock 3', intermediate rock 86, and cap rock 85 at the same time. In the particular construction illustrated, a first tube 45' leads from the pump 43' to a hole 33' in the crevice rock. A second tube 105 leads from the pump and splits into two branches 107 and 109. The branch 107 feeds water to an opening 75' in the intermediate rock. The branch 109 supplies water to the opening 101 in the cap rock. The water supplied to the cap rock runs from the depression 99 over the front end 87 into the depression 73' of the intermediate rock, arrow 111. The water from the cap rock joins the water supplied to the intermediate rock opening 75'. The combined water runs down the front end 63' of the intermediate rock and drops into the crevice rock, arrow 113. The entire system is designed to have minimum splash outside of the crevice rock, so only occasional replenishing of the water supply in the reservoir 69' is needed.

In summary, the results and advantages of landscape decorations can now be more fully realized. The system of modular artificial rocks provides both the attractive features of rock outcrops as well as realistic running water. This desirable result comes from using the combined functions of the reservoir and the crevice rock. The motor and pump in the reservoir supply water from below the water level on the crevice rock floor. Water flowing out the crevice rock runs along a convex portion of the crevice rock floor to a lowermost point, from which it falls back into the reservoir. The system may include one or more additional rocks in conjunction with the crevice rock. Each additional rock is designed to interfit with the crevice rock and to overhang it with a drip edge. Water supplied to the additional rocks runs down them and into the crevice rock. The additional rocks are designed to interfit interchangeably with a next lower rock and with the crevice rock. All the rocks are supplied with water simultaneously, so there is ample running water in the system. On the other hand, the system is designed to avoid water splashing outside of the system and being lost.

It will also be recognized that in addition to the superior performance of the present invention, its construction is such as to cost significantly less than natural stone landscaping. Also, the invention possesses the feature of running water that would be difficult, if not impossible, to duplicate with natural rocks.

Thus, it is apparent that there has been provided, in accordance with the invention, a system of modular artificial rocks with running water that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A system of modular artificial rocks with running water comprising:

a. a reservoir with an open top;

b. a crevice rock at least partially overlying the reservoir and comprising:

i. a floor having opposed exposed and hidden surfaces that define a first wall, the first wall defining a first hole therethrough;

ii. a barrier surrounding the floor and having exposed and hidden surfaces that define a second wall that is joined to the first wall, the second wall defining a second hole therethrough at a selected distance above the floor; and iii. a convex portion on the floor hidden surface that is over the reservoir; and c. means for pumping water from the reservoir to the first hole in the crevice rock, so that water pumped into the crevice rock first hole rises to the second hole and flows therethrough to the barrier hidden surface and runs down the convex portion of the floor and falls into the reservoir.

2. The system of claim 1 wherein:

a. the crevice rock convex portion has a first area, and the crevice rock barrier hidden surface has a second area proximate the convex portion first area;

b. the first and second areas blend into each other at a smooth junction; and c. the second hole is located above the junction, so that water flowing out the crevice rock second hole runs down the junction to the convex portion.

3. The system of claim 1 wherein the crevice rock floor is formed with a depression, and wherein the first hole opens into the depression.

4. The system of claim 3 wherein the crevice rock convex portion has generally the same shape, size, and contour as the depression.

5. The system of claim 3 wherein the reservoir has an opening that is exposed outside of the crevice rock.

6. A system of modular artificial rocks with running water comprising:

a. a reservoir with an open top;

b. a crevice rock at least partially overlying the reservoir and comprising:

i. a floor having opposed exposed and hidden surfaces that define a first wall, the first wall defining a first hole therethrough;

ii. a barrier surrounding the floor and having exposed and hidden surfaces that define a second wall that is joined to the first wall, the second wall defining a second hole therethrough at a selected distance above the floor; and iii. a convex portion on the floor hidden surface that is over the reservoir;

c. means for pumping water from the reservoir to the first hole in the crevice rock; and d. a cap rock having front and back ends, and top and bottom surfaces, the bottom surface interfitting over the crevice rock barrier such that the cap rock front end is over the crevice rock floor and the cap rock back end overhangs outside of the crevice rock barrier, so that water pumped into the crevice rock first hole rises to the second hole and flows therethrough to the barrier hidden surface and runs down the convex portion of the floor and falls into the reservoir.

7. The system of claim 6 wherein:

a. the cap rock front end and bottom surface join at a drip edge;

b. the cap rock has a hole through the top surface thereof; and c. the means for pumping water pumps water from the reservoir simultaneously to the first hole in the crevice rock and to the hole in the cap rock top surface, the water pumped to the hole in the cap rock running down the cap rock front end to the drip edge and then into the crevice rock.

8. A system of modular artificial rocks with running water comprising:

a. a reservoir with an open top;

b. a crevice rock at least partially overlying the reservoir and comprising:

i. a floor having opposed exposed and hidden surfaces that define a first wall, the first wall defining a first hole therethrough;

ii. a barrier surrounding the floor and having exposed and hidden surfaces that define a second wall that is joined to the first wall, the second wall defining a second hole therethrough at a selected distance above the floor; and iii. a convex portion on the floor hidden surface that is over the reservoir;

c. means for pumping water from the reservoir to the first hole in the crevice rock;

d. an intermediate rock having front and back ends, and top and bottom surfaces, the intermediate rock bottom surface interfitting over the crevice rock barrier such that the intermediate rock front end is over the crevice rock floor and the intermediate rock back end overhangs outside of the crevice rock barrier; and e. a cap rock having front and back ends, and top and bottom surfaces, the cap rock bottom surface interfitting over the intermediate rock top surface such that the cap rock front end is over the intermediate rock top surface and the cap rock back end overhangs outside of the intermediate rock back end, so that water pumped into the crevice rock first hole rises to the second hole and flows therethrough to the barrier hidden surface and runs down the convex portion of the floor and falls into the reservoir.

9. The system of claim 8 wherein:

a. the cap rock front end and bottom surface join at a first drip edge;

b. the cap rock has a hole through the top surface thereof;

c. the intermediate rock front end and bottom surface join at a second drip edge;

d. the intermediate rock has a hole through the top surface thereof; and e. the means for pumping water pumps water from the reservoir simultaneously to the first hole in the cap rock and to the holes in the cap rock top surface and intermediate rock top surface, so that the water pumped to the hole in the cap rock runs down the cap rock front end to the first drip edge and onto the intermediate rock top surface, the water pumped to the hole in the intermediate rock top surface mixes with the water pumped to the hole in the cap rock top surface and runs therewith down the front end of the intermediate rock to the second drip edge and then into the crevice rock.

10. An artificial rock comprising a floor and a barrier surrounding and upstanding from the floor, the barrier and the floor defining a wall with opposed exposed and hidden surfaces, the floor defining a first hole through the wall, the floor hidden surface having a convex portion with a first area that blends at a junction into a selected second area of the barrier hidden surface, the barrier defining a second hole through the wall at a location above the second area of the barrier hidden surface, so that water is able to enter the artificial rock through the first hole and rise to the second hole and flow out the second hole and run from the second area down the junction and first area to the convex portion.

11. The artificial rock of claim 10 wherein the floor defines a depression.

12. The artificial rock of claim 11 wherein the first hole is in the floor depression.

13. The artificial rock of claim 11 wherein the convex portion generally follows the shape of the floor depression.

14. Decorative landscaping apparatus comprising:

a. a reservoir having an open top;

b. a first artificial modular rock comprising:

i. a floor having exposed and hidden surfaces with a floor wall therebetween, the floor hidden surface having a convex portion that is over the reservoir, the floor wall defining a first hole therethrough; and ii. a barrier surrounding and upstanding from the floor and having an exposed surface and a hidden surface with a barrier wall therebetween, the barrier hidden surface having a first area that blends at a junction with a second area of the floor convex portion, the barrier wall defining a second hole therethrough above the first area; and c. means for pumping water from the reservoir to the first hole, so that the water rises in the first rock to the level of the second hole, and the water flows through the second hole, runs down the first area to the junction to the second area and to the convex portion and falls from the convex portion into the reservoir.

15. The apparatus of claim 14 wherein the first rock has a depression in the floor.

16. The apparatus of claim 15 wherein the first hole is in the floor depression.

17. The apparatus of claim 15 wherein the floor depression generally follows the contour of the floor convex portion.

18. Decorative landscaping apparatus comprising:

a. a reservoir having an open top;

b. a first artificial modular rock comprising:

i. a floor having exposed and hidden surfaces with a floor wall therebetween, the floor hidden surface having a convex portion that is over the reservoir, the floor wall defining a first hole therethrough; and ii. a barrier surrounding and upstanding from the floor and having an exposed surface and a hidden surface with a barrier wall therebetween, the barrier hidden surface having a first area that blends at a junction with a second area of the floor convex portion, the barrier wall defining a second hole therethrough above the first area;

c. means for pumping water from the reservoir to the first hole; and d. a second artificial rock having front and back ends, and a bottom surface that rests on and interfits with the first rock barrier, the second rock front end overhanging the first rock floor, so that the water rises in the first rock to the level of the second hole, and the water flows through the second hole, runs down the first area to the junction to the second area and to the convex portion and falls from the convex portion into the reservoir.

19. The apparatus of claim 18 wherein:

a. the second rock has a top surface with a top hole therethrough;

b. the means for pumping water from the reservoir comprises means for pumping water from the reservoir simultaneously to the first hole in the first rock and to the top hole in the second rock; and c. the water flows out of the top hole in the second rock and runs down the second rock front end and falls into the first rock floor.

20. The apparatus of claim 18 further comprising a third artificial rock having front and back ends, and a bottom surface that rests on and interfits with the second rock, the third rock back end overhanging the second rock back end.

21. The apparatus of claim 20 wherein:

a. the second and third rocks have respective top surfaces with respective second and third top holes therein;

b. the means for pumping water from the reservoir comprises means for pumping water from the reservoir simultaneously to the first hole in the first rock, to the second top hole in the second rock, and to the third top hole in the third rock;

c. the water flows out of the third top hole in the third rock and runs down the third rock front end and falls onto the second rock, and further runs down the front end of the second rock and falls into the first rock floor; and d. the water flows out of the second top hole in the second rock and runs down the second rock front end and falls onto the first rock floor.

22. A system of modular artificial rocks comprising:

a. a crevice rock having a floor with exposed and hidden surfaces and a floor wall therebetween that defines a first hole therethrough, the floor hidden surface having a convex portion, and a barrier upstanding from the floor and having exposed and hidden surfaces with a barrier wall therebetween that defines a second hole therethrough proximate the floor convex portion;

b. a reservoir having a top opening under the crevice rock convex portion; and c. means for pumping water from the reservoir to the crevice rock first hole, wherein the water rises on the crevice rock floor to the second hole and flows out the second hole and runs down the barrier wall hidden surface to the convex portion and falls therefrom into the reservoir.

23. A system of modular artificial rocks comprising:

a. a crevice rock having a floor with exposed and hidden surfaces and a floor wall therebetween that defines a first hole therethrough, the floor hidden surface having a convex portion, and a barrier upstanding from the floor and having exposed and hidden surfaces with a barrier wall therebetween that defines a second hole therethrough proximate the floor convex portion;

b. a reservoir having a top opening under the crevice rock convex portion; and c. means for pumping water from the reservoir to the crevice rock first hole, wherein the water rises on the crevice rock floor to the second hole and flows out the second hole and runs down the barrier wall hidden surface to the convex portion and falls therefrom into the reservoir, wherein:

i. the system further comprises a second rock having a top surface that defines a first top hole therethrough, a bottom surface that interfits with the crevice rock barrier, a front end that overhangs the crevice rock floor, and a back end; and ii. the means for pumping water pumps water simultaneously to the first hole in the crevice rock and to the first top hole in the second rock, wherein the water flows out of the first top hole in the second rock and runs down the second rock front end and falls into the crevice rock floor.

24. A system of modular artificial rocks comprising:

a. a crevice rock having a floor with exposed and hidden surfaces and a floor wall therebetween that defines a first hole therethrough, the floor hidden surface having a convex portion, and a barrier upstanding from the floor and having exposed and hidden surfaces with a barrier wall therebetween that defines a second hole therethrough proximate the floor convex portion;

b. a reservoir having a top opening under the crevice rock convex portion; and c. means for pumping water from the reservoir to the crevice rock first hole, wherein the water rises on the crevice rock floor to the second hole and flows out the second hole and runs down the barrier wall hidden surface to the convex portion and falls therefrom into the reservoir, wherein:

the system further comprises:

i. a second rock having a top surface that defines a first top hole therethrough, a bottom surface that interfits with the crevice rock barrier, a front end that is over the crevice rock floor, and a back end that overhangs the crevice rock barrier; and ii. a third rock having a top surface that defines a second top hole therethrough, a bottom surface that interfits with the second rock top surface, a front end that is over the second rock top surface, and a back end that overhangs the second rock back end; and the means for pumping water pumps water simultaneously to the first hole in the crevice rock and to the first top hole and second top hole in the second and third rocks, respectively, wherein the water flows out of the second top hole and runs down the third rock front end and falls onto the second rock top surface, and wherein the water flows out of the first top hole and mixes with the water from the third rock, the mixed water running down the second rock front end and falling into the crevice rock floor.

25. A method of landscaping comprising the steps of:

a. providing an open top reservoir;

b. providing a crevice rock having a floor defined by a floor wall having an exposed surface and a hidden surface with a convex portion, and a barrier wall upstanding from the floor wall;

c. placing the crevice rock floor convex portion over the reservoir;

d. pumping water through the floor wall onto the floor wall exposed surface;

e. flowing the water on the floor exposed surface through the barrier wall to the floor convex portion; and flowing the water from the floor convex portion into the reservoir.

26. The method of claim 25 wherein:

a. the step of providing a crevice rock comprises thee steps of providing a crevice rock having a depression in the floor wall; and b. the step of pumping water comprises the step of pumping water through the floor wall into the floor depression.

27. A method of landscaping comprising the steps of:

a. providing an open top reservoir;

b. providing a crevice rock having a floor defined by a floor wall having an exposed surface and a hidden surface with a convex portion, and a barrier wall upstanding from the floor wall;

c. placing the crevice rock floor convex portion over the reservoir;

d. pumping water through the floor wall onto the floor wall exposed surface;

e. flowing the water on the floor exposed surface through the barrier wall to the floor convex portion;

f. flowing the water from the floor convex portion into the reservoir;

g. providing a second rock having a bottom surface, a top surface, and wall;

h. interfitting the second rock bottom surface on the crevice rock barrier wall;

i. pumping water through the second rock wall to the second rock top surface; and j. flowing the water from the second rock top surface onto the crevice rock floor.

28. The method of claim 27 comprising the further steps of:

a. providing a third rock having a bottom surface, a top surface, and wall;

b. interfitting the third rock bottom surface on the second rock top surface;

c. pumping water through the third rock wall to the third rock top surface; and d. flowing the water from the third rock top surface to the second rock top surface.

* * * * *